US010546688B2

(12) United States Patent
Ichigozaki et al.

(10) Patent No.: US 10,546,688 B2
(45) Date of Patent: Jan. 28, 2020

(54) METHOD FOR PRODUCING RARE-EARTH MAGNET

(71) Applicant: TOYOTA JIDOSHA KABUSHIKI KAISHA, Toyota-shi, Aichi (JP)

(72) Inventors: Daisuke Ichigozaki, Toyota (JP); Takeshi Yamamoto, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 34 days.

(21) Appl. No.: 15/841,681

(22) Filed: Dec. 14, 2017

(65) Prior Publication Data

US 2018/0182542 A1 Jun. 28, 2018

(30) Foreign Application Priority Data

Dec. 27, 2016 (JP) ..... 2016-253697

(51) Int. Cl.
*H01F 41/02* (2006.01)
*B22F 3/16* (2006.01)

(52) U.S. Cl.
CPC ..... *H01F 41/0273* (2013.01); *B22F 3/164* (2013.01); *B22F 2998/10* (2013.01); *B22F 2999/00* (2013.01)

(58) Field of Classification Search
CPC .. H01F 41/00; H01F 41/0266; H01F 41/0273; B22F 2998/00; B22F 2998/10
See application file for complete search history.

(56) References Cited

U.S. PATENT DOCUMENTS

2001/0041146 A1* 11/2001 Ogawa ..... B22F 3/03 419/38
2013/0248754 A1 9/2013 Sakuma et al.
(Continued)

FOREIGN PATENT DOCUMENTS

CN 104737250 A 6/2015
CN 105312575 A 2/2016
(Continued)

OTHER PUBLICATIONS

Espacenet translation of JP2002075715 retrieved on Apr. 25, 2019 (Year: 2002).*

*Primary Examiner* — Keith D. Hendricks
*Assistant Examiner* — Joshua S Carpenter
(74) *Attorney, Agent, or Firm* — Sughrue Mion, PLLC

(57) ABSTRACT

Provided is a method for producing a rare-earth magnet that can resolve a problem of deterioration of the residual magnetization and coercive force of the rare-earth magnet due to spring-back in producing the rare-earth magnet through performing hot deformation processing of upsetting on a sintered body. The method includes a first step of producing the sintered body through press-forming of magnetic powder for a rare-earth magnet, and a second step of producing a rare-earth magnet precursor through hot deformation processing of upsetting in which the sintered body is placed within a plastic processing mold and is pressurized in a predetermined direction so as to impart magnetic anisotropy to the sintered body, and performing cooling of the rare-earth magnet precursor while a predetermined pressure is kept being applied thereto in the predetermined direction, so that the rare-earth magnet is produced.

1 Claim, 8 Drawing Sheets

(56) References Cited

U.S. PATENT DOCUMENTS

| | | | | |
|---|---|---|---|---|
| 2014/0191443 | A1* | 7/2014 | Park | B22F 3/105 264/434 |
| 2015/0279559 | A1* | 10/2015 | Miyamoto | B22F 3/14 419/38 |
| 2016/0027565 | A1 | 1/2016 | Kano et al. | |
| 2016/0086704 | A1* | 3/2016 | Namkung | H01F 1/0576 335/302 |

FOREIGN PATENT DOCUMENTS

| | | | | | |
|---|---|---|---|---|---|
| EP | 485353 | A1 | * | 11/1990 | B82Y 25/00 |
| JP | 4134804 | A | | 5/1992 | |
| JP | 2002075715 | A | * | 3/2002 | H01F 1/0579 |
| JP | 2002075715 | A | | 3/2002 | |
| JP | 2014502034 | A | | 1/2014 | |
| JP | 2014194958 | A | | 10/2014 | |
| JP | 2016029679 | A | | 3/2016 | |

* cited by examiner

METHOD FOR PRODUCING RARE-EARTH MAGNET

CROSS REFERENCE TO RELATED APPLICATIONS

The present application claims priority from Japanese patent application JP 2016-253697 filed on Dec. 27, 2016, the content of which is hereby incorporated by reference into this application.

BACKGROUND

Technical Field

The present disclosure relates to a method for producing a rare-earth magnet through performing hot deformation processing on a sintered body.

Background Art

Rare-earth magnets formed using rare-earth elements such as lanthanoide are called permanent magnets as well, and are used for motors of hard disks and MRI systems as well as for driving motors for hybrid vehicles, electric vehicles, and the like.

Indexes for magnet performance of such rare-earth magnets include residual magnetization (residual flux density) and a coercive force. Meanwhile, in response to an increase in the amount of heat generated at a motor because of the trend to form more compact motors and increase the current density, rare-earth magnets used for the motors have also been required to have improved heat resistance, and one of the important research challenges in the technical field is how to retain the magnetic properties of a magnet operating at high temperatures.

The following briefly describes one example of the method for producing a rare-earth magnet. For instance, in a typical method, Nd—Fe—B molten metal is solidified rapidly to become fine powder, and the obtained fine power is press-formed to produce a sintered body, and then hot deformation processing is performed on the sintered body to impart magnetic anisotropy thereto to produce a rare-earth magnet (oriented magnet). It should be noted that JP H04-134804 A discloses a method for producing a rare-earth magnet with high residual magnetization and coercive force, through performing hot deformation processing on a sintered body so as to orient crystalline grains.

As the aforementioned hot deformation processing, upsetting (hot upsetting) is typically used that uses a plastic processing mold including side-face dies and upper and lower dies (also referred to as punches) slidable within the side-face dies and in which a sintered body is placed within the plastic processing mold and is pressurized by means of the upper and lower dies while being heated until a predetermined degree of processing is reached.

SUMMARY

A rare-earth magnet produced through hot deformation processing is taken out of a plastic processing mold and transferred while the temperature at the time of the hot deformation processing is maintained. During this process, spring-back is often generated by the spring-back force due to the elasticity of the rare-earth magnet slightly remaining therein. In particular, when upsetting is performed as the hot deformation processing, immediately after the rare-earth magnet is formed through plastic deformation of a sintered body through performing the hot deformation processing, the pressure is released, and the spring-back thus becomes significant.

If the spring-back is generated in the rare-earth magnet, there is a problem in that the oriented structure or grain boundary phase structure that has been formed through the hot deformation processing is damaged, and as a result, the residual magnetization and coercive force of the rare-earth magnet are deteriorated.

The present disclosure has been made in view of the aforementioned problem, and provides a method for producing a rare-earth magnet that can resolve the problem of the deterioration of the residual magnetization and coercive force of the rare-earth magnet due to spring-back in producing the rare-earth magnet through performing hot deformation processing of upsetting on a sintered body.

The method for producing a rare-earth magnet according to the present disclosure includes a first step of producing a sintered body through press-forming of magnetic powder for a rare-earth magnet, and a second step of producing a rare-earth magnet precursor through hot deformation processing of upsetting in which the sintered body is placed within a plastic processing mold and is pressurized in a predetermined direction so as to impart magnetic anisotropy to the sintered body, and performing cooling of the rare-earth magnet precursor while a predetermined pressure is kept being applied thereto in the predetermined direction, so that the rare-earth magnet is produced.

In the method for producing a rare-earth magnet of the present disclosure, after the hot deformation processing of upsetting, instead of immediately taking the rare-earth magnet precursor out of the plastic processing mold, cooling of the rare-earth magnet precursor is performed while a predetermined pressure is kept being applied thereto in the same direction (predetermined direction) as the pressuring direction in the hot deformation processing so that the rare-earth magnet is produced, thereby making it possible to suppress the generation of spring-back and deterioration of the residual magnetization and coercive force of the rare-earth magnet.

Herein, it is preferable to set the "predetermined pressure" in the second step to less than the pressuring load applied in the hot deformation processing and greater than or equal to the resistance load acting on the plastic processing mold due to expansion of the rare-earth magnet precursor.

Since the predetermined pressure is set to greater than or equal to the resistance load applied due to the expansion of the rare-earth magnet precursor, displacement of an upper die or a lower die of the plastic processing mold after the hot deformation processing can be suppressed, thereby suppressing the generation of spring-back. During this process, with the predetermined pressure applied to the rare-earth magnet precursor in the same direction as the pressuring direction in the hot deformation processing, the generation of spring-back in the direction opposite to the pressuring direction is effectively suppressed.

Since the generation of spring-back is suppressed, the cooling of the rare-earth magnet precursor is performed while its shape and dimension immediately after the hot deformation processing are maintained, and the rare-earth magnet to be finally obtained has the maintained shape and dimension of the rare-earth magnet precursor immediately after the hot deformation processing, so that the degree of orientation formed in the hot deformation processing is maintained.

Further, in the "cooling" in the second step, it is preferable to maintain the predetermined pressure until the temperature reaches or falls below a temperature at which a liquid phase component of the rare-earth magnet precursor solidifies.

With the predetermined pressure maintained until the temperature reaches or falls below a temperature at which the liquid phase component of the rare-earth magnet precursor solidifies, the rare-earth magnet is allowed to have the maintained shape and dimension of the rare-earth magnet precursor immediately after the hot deformation processing.

As understood from the foregoing description, according to the method for producing a rare-earth magnet of the present disclosure, after the hot deformation processing of upsetting, cooling of the rare-earth magnet precursor is performed while the predetermined pressure is kept being applied thereto in the same direction (predetermined direction) as the pressuring direction in the hot deformation processing so that the rare-earth magnet is produced, thereby making it possible to suppress the generation of spring-back and deterioration of the residual magnetization and coercive force of the rare-earth magnet.

DETAILED DESCRIPTION

Hereinafter, an embodiment of a method for producing a rare-earth magnet of the present disclosure will be described with reference to the drawings. The following illustrates an example of a rare-earth magnet including a nano-crystalline magnet (of around 300 nm or less in grain size) as a target of the producing method, but a rare-earth magnet as the target of the producing method of the present disclosure is not limited to a nano-crystalline magnet, and includes a magnet of 300 nm or more in grain size, a sintered magnet of 1 μm or more in grain size, and the like.

(Embodiment of the Method for Producing a Rare-Earth Magnet)

Figure 1:
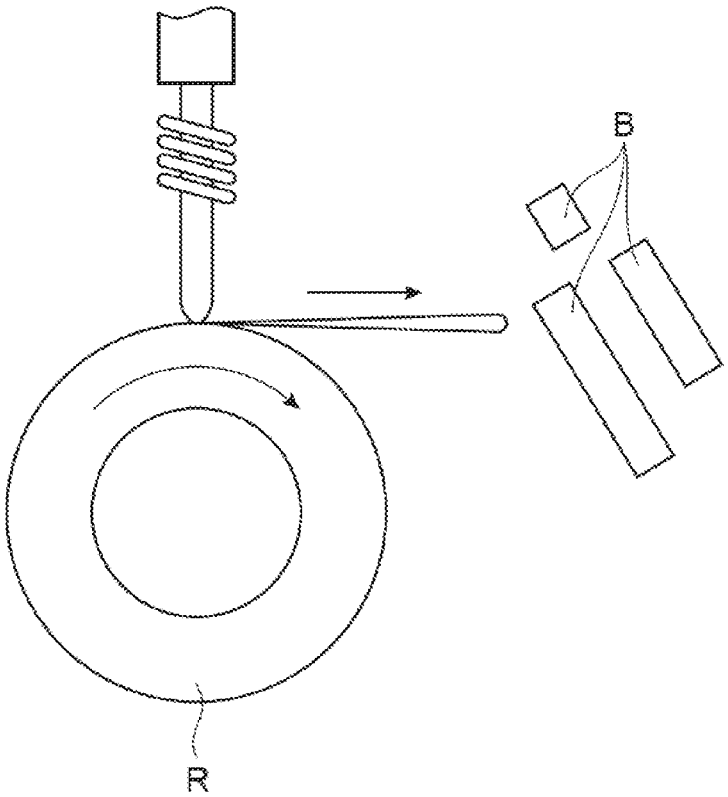
FIG. 1 schematically illustrates a method for producing magnetic powder that is used in a first step of a method for producing a rare-earth magnet of the present disclosure.
Figure 2:
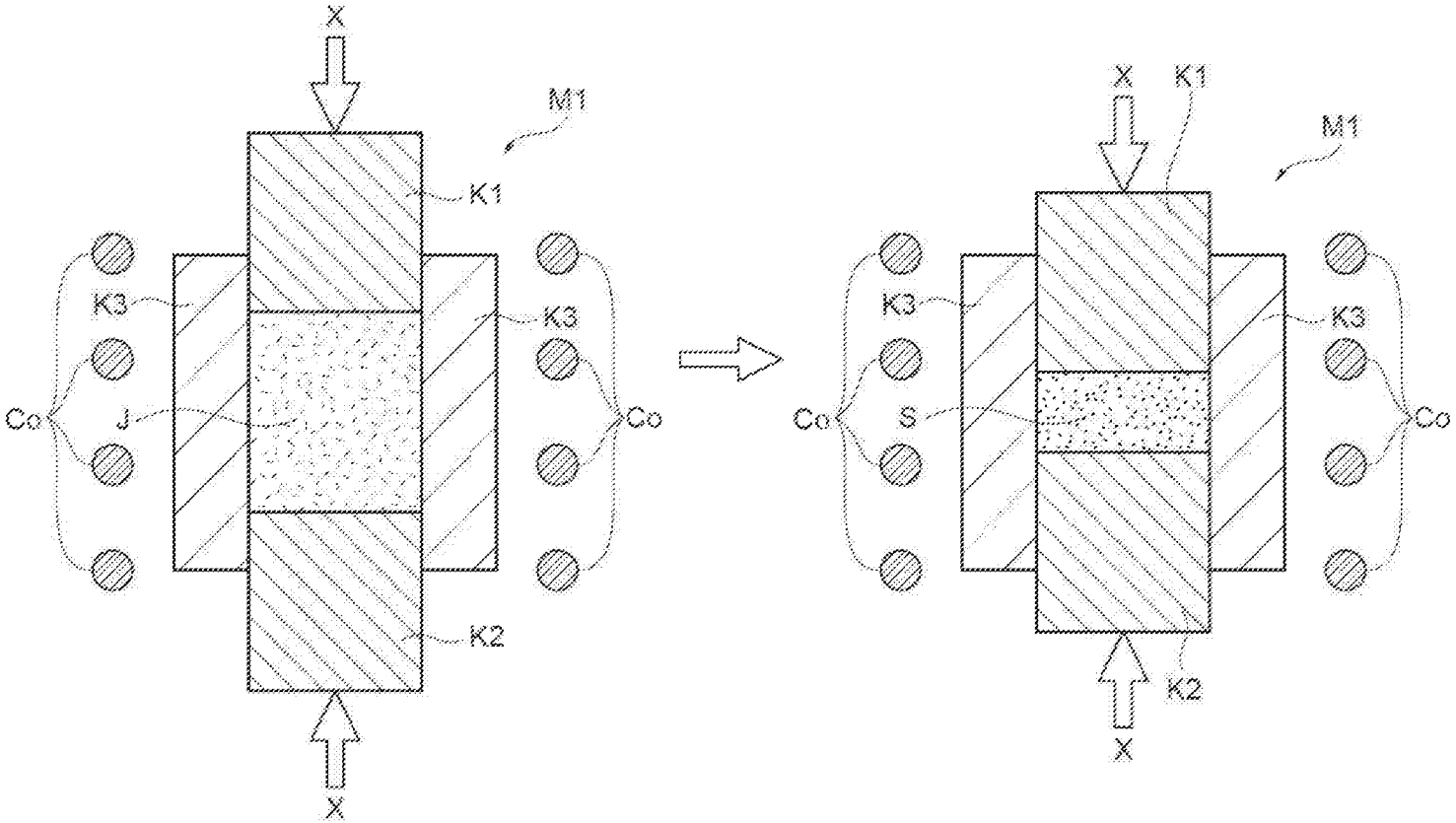
FIG. 2 illustrates the first step of the producing method.

FIG. 1 schematically illustrates a method for producing magnetic powder that is used in a first step of a method for producing a rare-earth magnet of the present disclosure; FIG. 2 illustrates the first step of the producing method; and FIG. 4 describes a second step of the producing method.

As illustrated in FIG. 1, an alloy ingot is molten at a high frequency, and the molten metal with a composition that provides a rare-earth magnet is sprayed onto a copper roll R to produce a melt-spun ribbon B (rapidly quenched ribbon) by a melt-spinning method using a single roll in an oven (not shown) under an Ar gas atmosphere at a reduced pressure of 50 kPa or lower, for example.

Next, as illustrated in FIG. 2, the inside of a cavity of a forming mold M1 that includes side-face dies K3, an upper die K1 and a lower die K2 that are slidable within the side-face dies K3, and a high-frequency coil Co is filled with magnetic powder J obtained through coarsely grinding the melt-spun ribbon B so as to have a grain size of around 200 μm or less, for example.

Then, the magnetic powder J is pressed in a vertical direction (x direction) by means of the upper die K1 and lower die K2 while heated by means of the high-frequency coil Co, so as to produce a sintered body S that includes a Nd—Fe—B main phase (having a crystalline grain size of around 50 to 200 nm) with a nano-crystalline structure and a Nd—X alloy (X: metal element) grain boundary phase around the main phase (first step).

Herein, the Nd—X alloy that forms the grain boundary phase is an alloy containing Nd and at least one element selected from the group consisting of Co, Fe, Ga, and the like, and the alloy includes, for example, any one of the elements selected from the group consisting of Nd—Co, Nd—Fe, Nd—Ga, Nd—Co—Fe, and Nd—Co—Fe—Ga, or a mixture of two or more of them, and is in a Nd-rich state.

Figure 3:
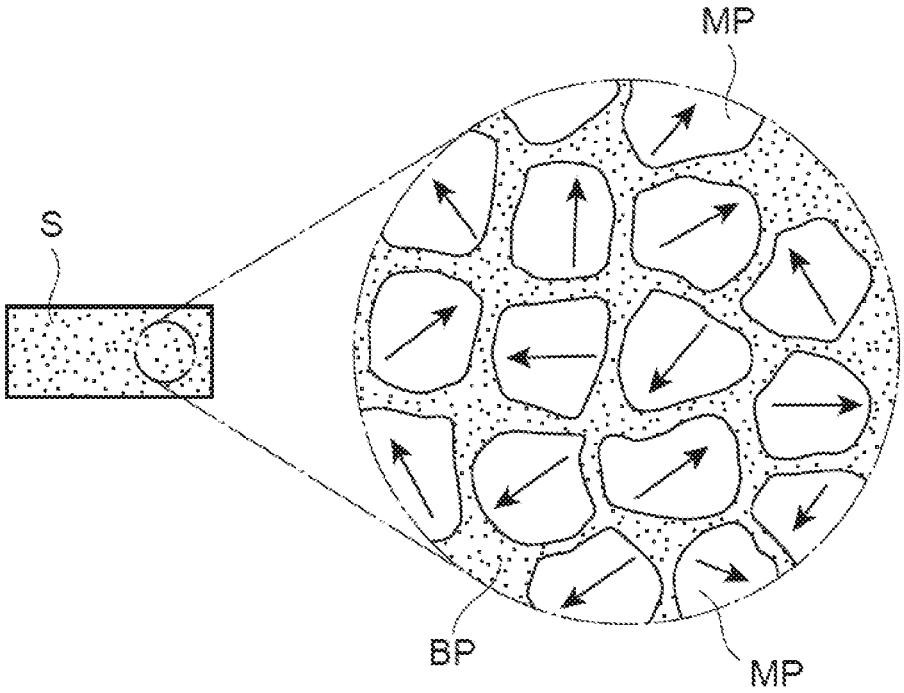
FIG. 3 illustrates the micro-structure of a sintered body produced in the first step.

As illustrated in FIG. 3, the sintered body S exhibits an isotropic crystalline structure where the gaps between the nano-crystalline grains MP (main phase) are filled with the grain boundary phase BP.

Figure 4:
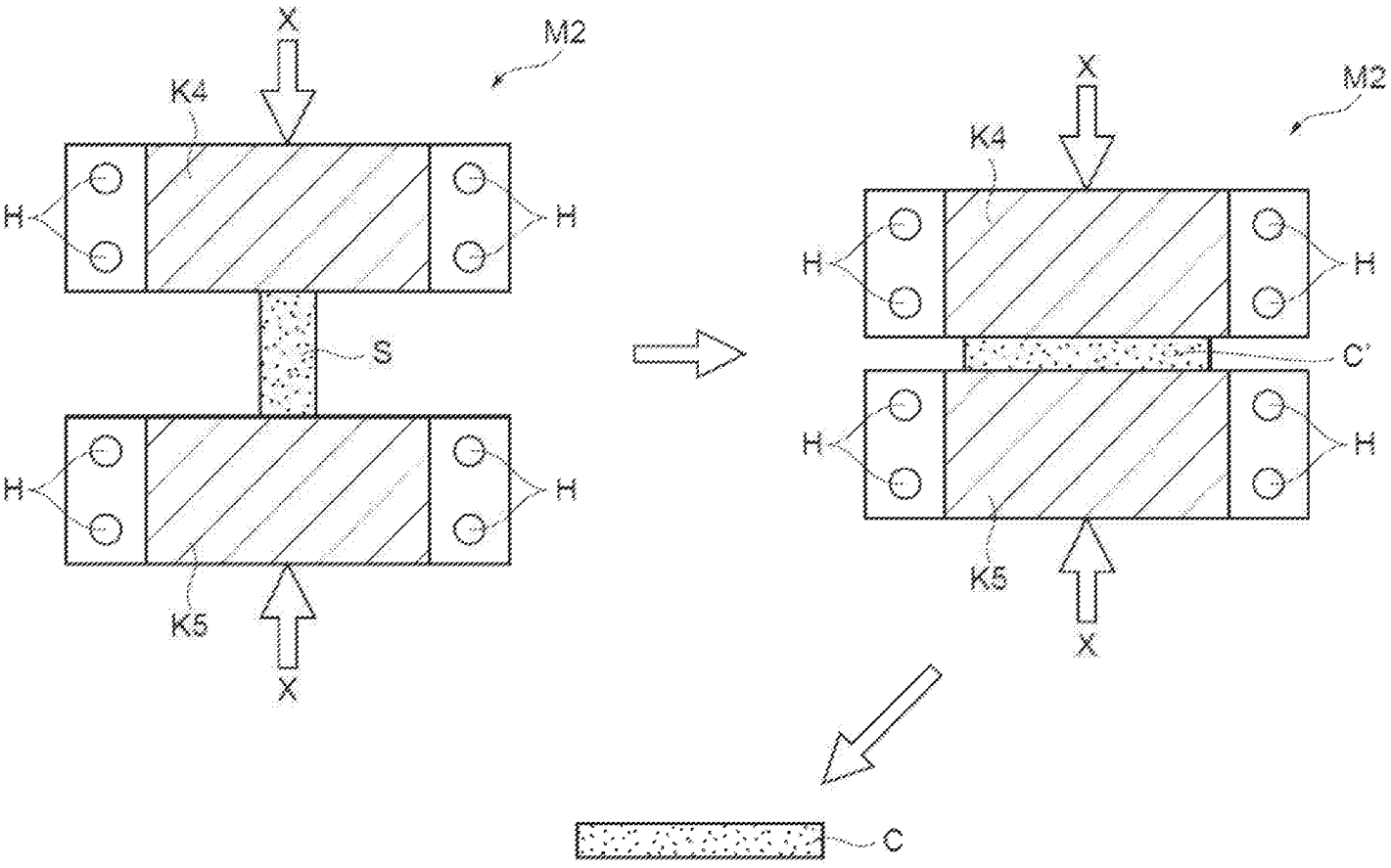
FIG. 4 illustrates a second step of the producing method.

Next, as illustrated in FIG. 4, the sintered body S is placed between an upper die K4 and a lower die K5 with built-in heaters H of a plastic processing mold M2. Then, while the pressure is applied to the sintered body S in the vertical direction (x direction) by means of the upper die K4 and lower die K5 heated by the heaters H, hot deformation processing of upsetting is performed for imparting magnetic anisotropy to the sintered body S, so that a rare-earth magnet precursor C' is produced.

Then, with the pressure kept being applied to the produced rare-earth magnet precursor C' in the vertical direction (x direction) as the pressuring direction in the hot deformation processing, the rare-earth magnet precursor C' is cooled with the temperatures of the heaters of the upper die K4 and lower die K5 gradually lowered, so that a rare-earth magnet C is produced (second step).

Herein, the pressure applied to the rare-earth magnet precursor C' during the cooling is set to less than the pressuring load applied during the hot deformation processing and equal to or greater than the resistance load applied due to expansion of the rare-earth magnet precursor C'.

Since the hot deformation processing has already been completed and a desired degree of orientation of the rare-earth magnet precursor C' has been obtained, it is not necessary to apply a load equal to or greater than the pressuring load applied in the hot deformation processing in performing the cooling.

Further, since the pressure applied to the rare-earth magnet precursor C' in performing the cooling is set to equal to or greater than the resistance load applied due to the expansion of the rare-earth magnet precursor C', displacement of the upper die K4 or lower die K5 of the plastic processing mold M2 after the hot deformation processing can be suppressed, thereby making it possible to suppress the generation of spring-back of the rare-earth magnet precursor C'.

In particular, with the pressure applied to the rare-earth magnet precursor C' in the same direction (x direction) as the pressuring direction in the hot deformation processing, spring-back of the rare-earth magnet precursor C' in the direction opposite to the pressuring direction can be effectively suppressed.

Further, in cooling the rare-earth magnet precursor C', with the pressure kept being applied thereto until the temperature reaches or falls below a temperature at which a liquid phase component of the rare-earth magnet precursor C' solidifies, the rare-earth magnet C to be finally obtained is allowed to maintain the shape and dimension of the rare-earth magnet precursor C' immediately after the hot deformation processing.

This means that the rare-earth magnet C maintains the degree of orientation of the rare-earth magnet precursor C' immediately after the hot deformation processing, thereby making it possible to suppress deterioration of the residual magnetization and coercive force of the rare-earth magnet C caused by the spring-back of the rare-earth magnet precursor C'.

An embodiment of producing a Nd—Fe—B nano-crystalline magnet as a rare-earth magnet includes the following: setting the temperature in performing the hot deformation processing to around 700 to 800° C. and in performing cooling in the second step, maintaining the predetermined pressure until the temperature of the rare-earth magnet precursor reaches or falls below 600° C.

Figure 5:
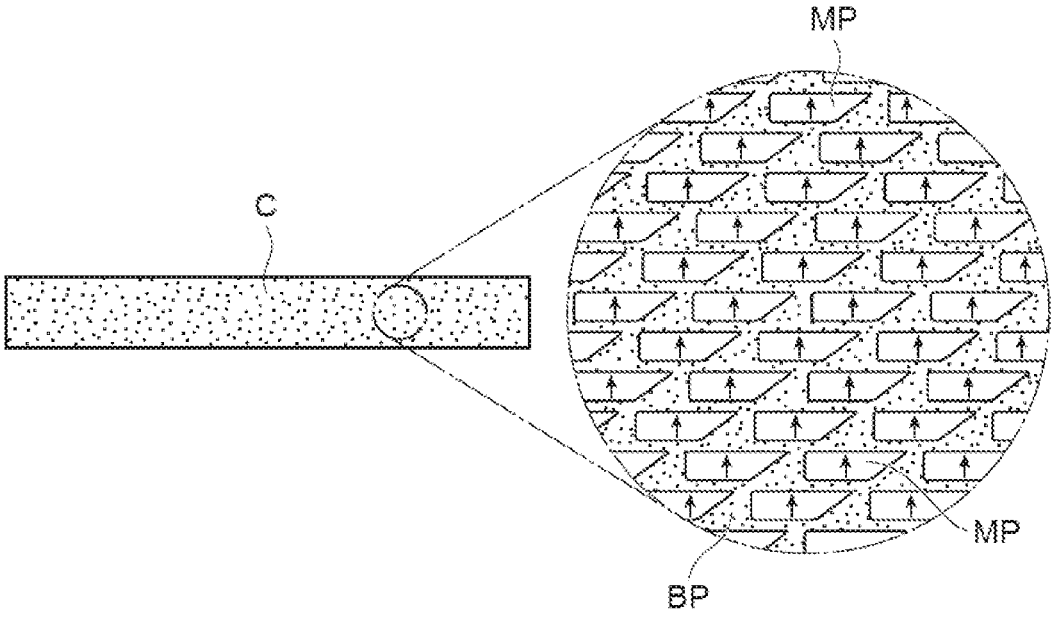
FIG. 5 illustrates the micro-structure of the rare-earth magnet produced.

FIG. 5 illustrates the micro-structure of the rare-earth magnet produced. The crystalline structure of the sintered body S in FIG. 3 shows an isotropic crystalline structure where the gaps between the nano-crystalline grains MP (main phase) are filled with the grain boundary phase BP. Meanwhile, as illustrated in FIG. 5, the rare-earth magnet C produced using the producing method of the present disclosure has magnetic anisotropy and a crystalline structure with a high degree of orientation.

It should be noted that a modifier alloy may be diffused through the grain-boundaries in the produced rare-earth magnet C to further improve the coercive force thereof. Herein, examples of the modifier alloy that can be used include the one containing a transition metal element and a light rare-earth element. With the use of a modifier alloy having a melting point or eutectic temperature in a relatively low range of around 450 to 700° C., for example, coarsening of crystalline grains can be suppressed. More specifically, examples of such a modifier alloy may include an alloy containing a light rare-earth element of either Nd or Pr and a transition metal element, such as Cu, Mn, In, Zn, Al, Ag, Ga, and Fe, for example, a Nd—Cu alloy (having a eutectic point of 520° C.), a Pr—Cu alloy (having a eutectic point of 480° C.), a Nd—Pr—Cu alloy, a Nd—Al alloy (having a eutectic point of 640° C.), a Pr—Al alloy (650° C.), and a Nd—Pr—Al alloy.

(Experiment for Verifying the Magnetic Properties of a Rare-Earth Magnet Produced Using the Producing Method of the Present Disclosure and the Results Thereof)

The present inventors conducted an experiment for verifying the magnetic properties of a rare-earth magnet produced using the producing method of the present disclosure. First, two types of test pieces of rare-earth magnets were prepared using magnetic powder obtained from two types of melt-spun ribbons with Compositions A and B shown in Table 1 below. The test piece of Example was produced using the producing method of the present disclosure, while the test piece of Comparative Example was produced using a producing method in which immediately after the hot deformation processing, cooling was performed while the pressure was released.

The preparation of a sintered body was performed at a temperature of 700° C., at a pressure of 1500 MPa, and for a holding time of 20 minutes in an Ar atmosphere, and the hot deformation processing was performed at a temperature of 780° C., with a rate of strain of 0.1/sec, and with a rolling reduction of Red. 70% in the air atmosphere.

TABLE 1

| IPC analysis results | | | | | |
|---|---|---|---|---|---|
| | Nd | Pr | Fe (bal.) | Co | B |
| Composition A | 30.9 | 0.4 | Bal. | 0.0 | 1.2 |
| Composition B | 28.7 | 0.4 | Bal. | 1.0 | 1.1 |

Figure 6:
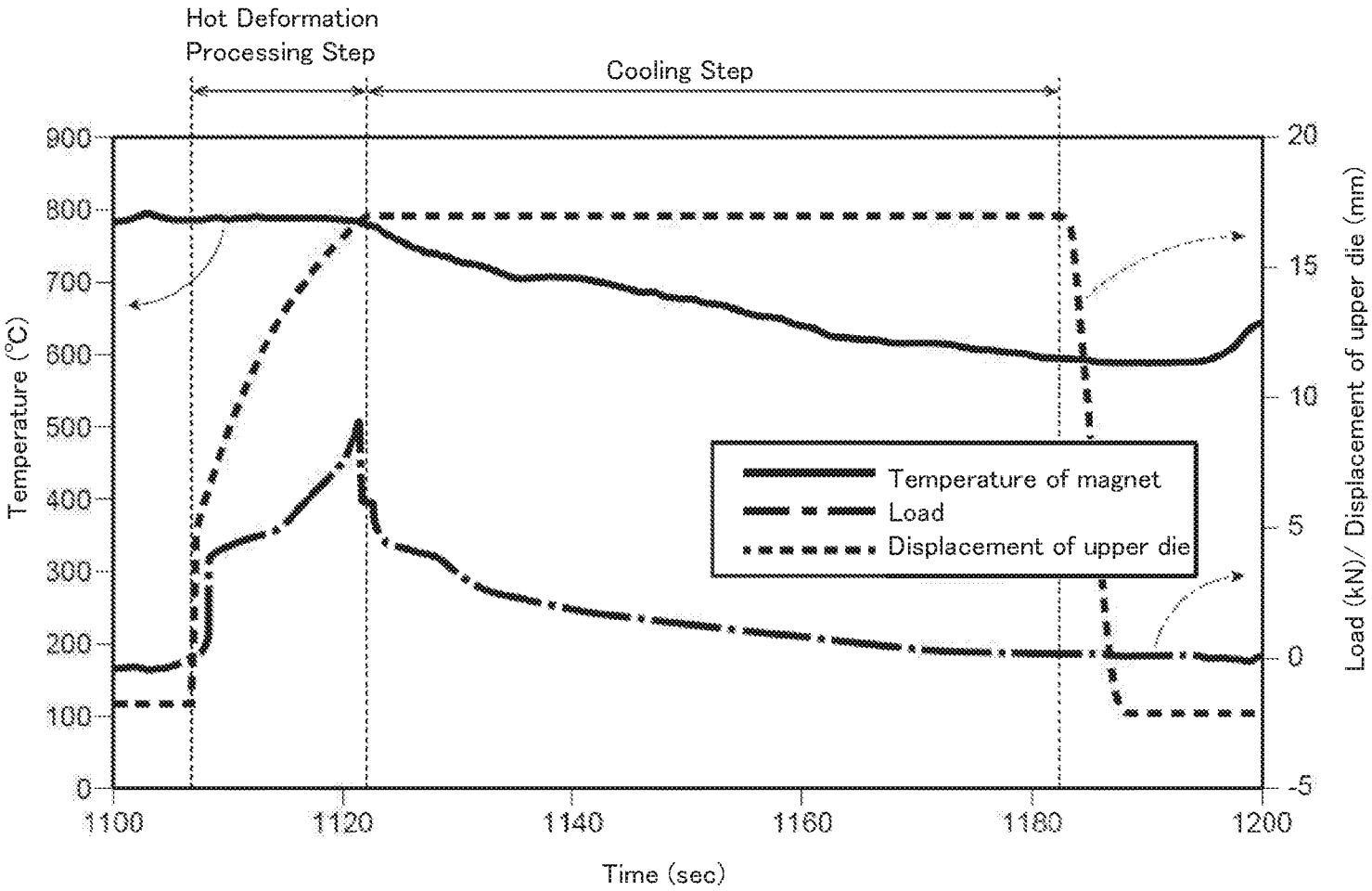
FIG. 6 is a graph illustrating control of a displacement and temperature of and a load on a plastic processing mold in the producing method of Example.

In the producing method of Example, a displacement and temperature of and a load on the plastic processing mold in the second step were controlled as illustrated in the graph of FIG. 6.

Specifically, in the cooling after the hot deformation processing, the load applied to the upper die is controlled so that displacement of the upper die of the plastic processing mold does not fluctuate. The spring-back becomes significant immediately after the hot deformation processing, and therefore, in order to suppress such spring-back, it is necessary to apply the maximum load to the upper die immediately after the hot deformation processing as illustrated in FIG. 6. Then, in the cooling, as time passes, the spring-back force acting on the upper die decreases. Thus, the spring-back force was measured using a pressure sensor or the like mounted on the upper die, and a load (that is less than the pressuring load applied in the hot deformation processing and equal to or greater than the resistance load) equal to or greater than the measured value (that corresponds to the resistance load) was applied to the upper die in accordance therewith, so that the displacement of the upper die was controlled to zero.

The hot deformation processing was performed at a temperature of 800° C. and during the cooling, the temperature was gradually lowered from 800° C. to 600° C. in 60 seconds.

After the cooling, the spring-back force rapidly decreased, and the value of the load applied to the upper die was gradually brought near to zero.

Figure 7:
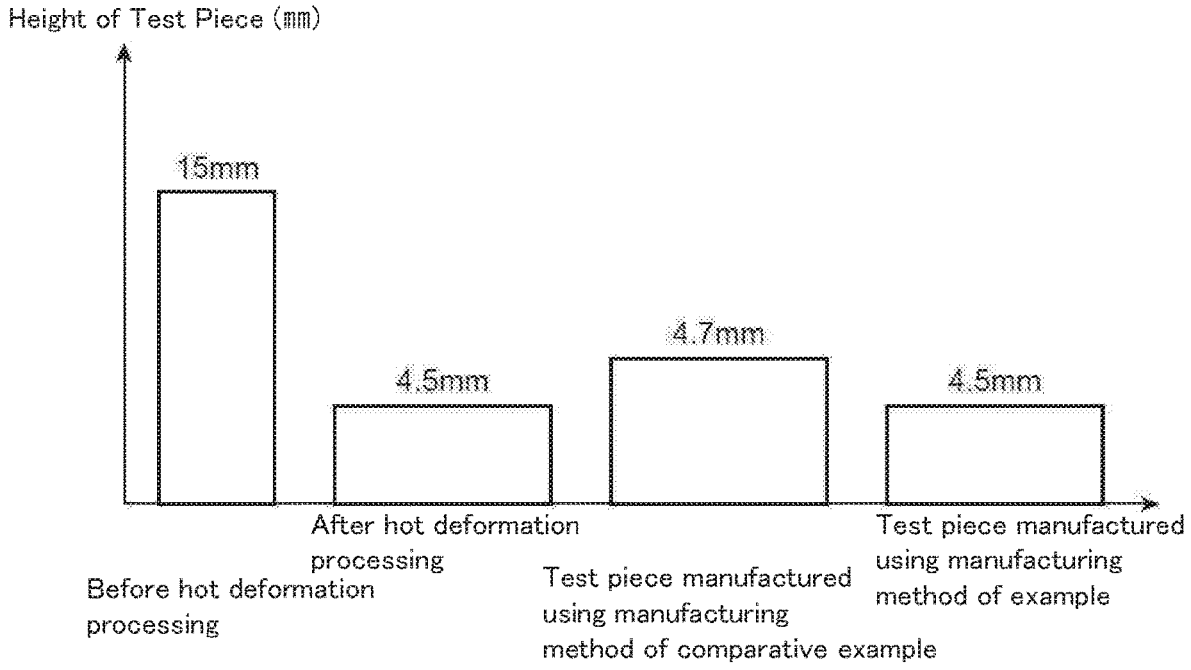
FIG. 7 illustrates the results of an experiment on the height of each of test pieces produced using producing methods of Example and Comparative Example.
Figure 8:
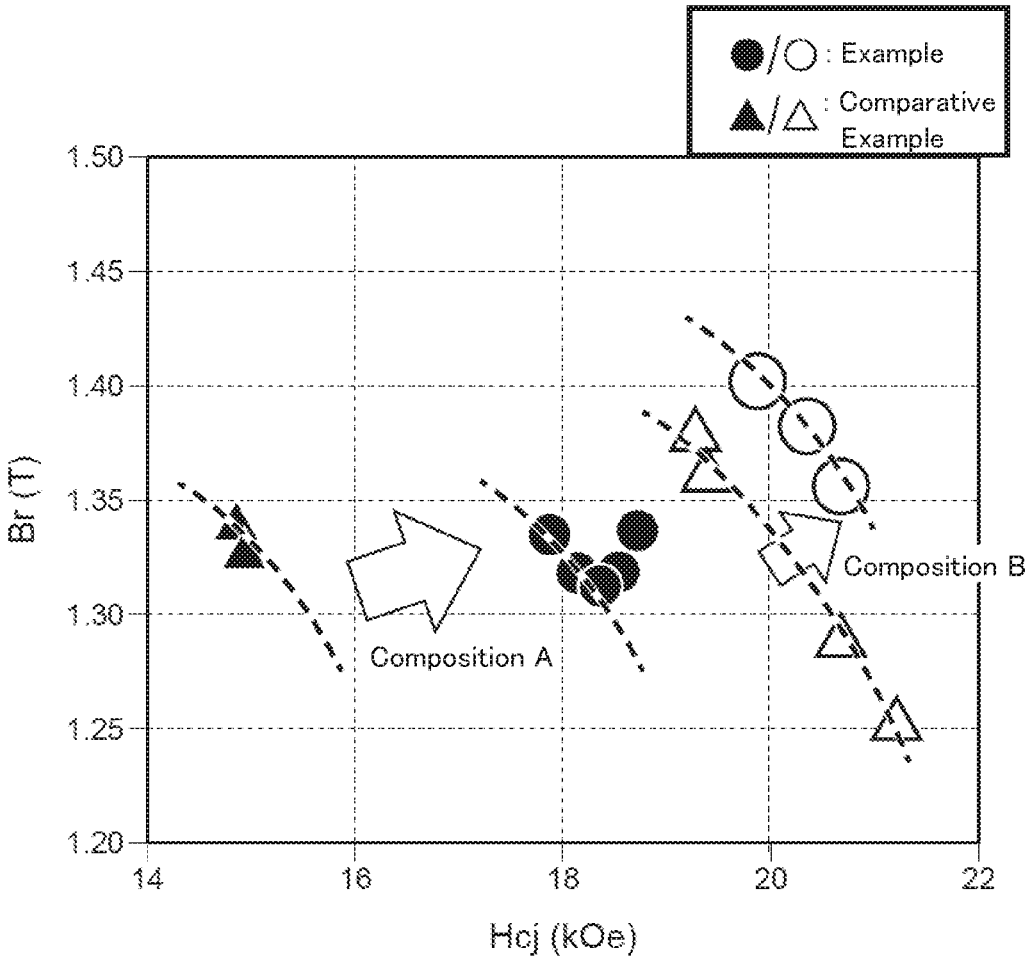
FIG. 8 illustrates the results of an experiment on the coercive force and residual magnetization of each of the test pieces produced using the producing methods of Example and Comparative Example.

Regarding the test pieces produced using the producing methods of Example and Comparative Example that use Compositions A and B, FIG. 7 illustrates the results of an experiment on the height of each of the test pieces and FIG. 8 illustrates the results of an experiment on the coercive force and residual magnetization of each of the test pieces.

FIG. 7 can confirm that the heights of the test pieces before and immediately after the hot deformation processing were 15 mm and 4.5 mm, respectively.

Further, in the method of Comparative Example in which cooling was performed while the pressure was released immediately after the hot deformation processing, spring-back of 0.2 mm was generated, and the height of the rare-earth magnet finally obtained was 4.7 mm.

In contrast, in the method of Example in which cooling was performed with the pressure kept being applied to the rare-earth magnet precursor after the hot deformation processing, spring-back was not generated, and the height of the rare-earth magnet finally obtained was 4.5 mm that is the same as that of the test piece immediately after the hot deformation processing.

The results in FIG. 8 show that regarding the magnetic properties of each of the test pieces, in both cases of using magnetic materials with Compositions A and B, the test piece of Example exhibited better numerical values than those of Comparative Example in both the coercive force and residual magnetization.

Specifically, it has been found that the coercive force of Composition A of Example exhibited better than that of Comparative Example by around 3 kOe and that the coercive force and the residual magnetization of Composition B of Example exhibited better by around 2 kOe and around 0.1 T, respectively, as compared to those of Comparative Example.

The results of the experiments demonstrate that the rare-earth magnet produced using the producing method according to the present disclosure has excellent magnetic properties because the problem of generation of spring-back after the hot deformation processing is resolved.

Although the embodiment of the present disclosure has been described in detail with reference to the drawings, the specific configuration is not limited thereto, and any design changes are possible without departing from the spirit and scope of the present disclosure.

DESCRIPTION OF SYMBOLS

R Copper roll
B Melt-spun ribbon (rapidly quenched ribbon)
J Magnetic powder
K1, K4 Upper die
K2, K5 Lower die
K3 Side-face die
M1 Forming mold
M2 Plastic processing mold
S Sintered body
C' Rare-earth magnet precursor
C Rare-earth magnet (orientational magnet)
MP Main phase (nano-crystalline grains, crystalline grains, crystals)
BP Grain boundary phase

What is claimed is:

1. A method for producing a rare-earth magnet, comprising:

a first step of producing a sintered body through press-forming of magnetic powder for a rare-earth magnet; and a second step of producing a rare-earth magnet precursor through hot deformation processing of upsetting, wherein the sintered body is placed within a plastic processing mold and is pressurized in a predetermined direction by means of the plastic processing mold so as to impart magnetic anisotropy to the sintered body, and performing cooling of the rare-earth magnet precursor heated through the hot deformation processing, inside the plastic processing mold, while a predetermined pressure is kept being applied thereto in the predetermined direction by means of the plastic processing mold, so that a rare-earth magnet is produced, wherein the predetermined pressure is less than a pressuring load applied in the hot deformation processing and greater than or equal to a resistance load acting on the plastic processing mold due to expansion of the rare-earth magnet precursor, and during the cooling of the rare-earth magnet precursor heated through the hot deformation processing, the predetermined pressure is maintained until a temperature of the rare-earth magnet precursor reaches or falls below a temperature at which a liquid phase component of the rare-earth magnet precursor solidifies.

* * * * *